US010272552B2

(12) United States Patent
Joos

(10) Patent No.: US 10,272,552 B2
(45) Date of Patent: Apr. 30, 2019

(54) TOOL FOR INSTALLING FITTED BED SHEETS

(71) Applicant: Patricia Jane Joos, Estacada, OR (US)

(72) Inventor: Patricia Jane Joos, Estacada, OR (US)

(73) Assignee: Patricia York Joos, Estacada, OR (US)

( * ) Notice: Subject to any disclaimer, the term of this patent is extended or adjusted under 35 U.S.C. 154(b) by 370 days.

(21) Appl. No.: 15/337,527

(22) Filed: Oct. 28, 2016

(65) Prior Publication Data

US 2017/0119170 A1 May 4, 2017

Related U.S. Application Data

(60) Provisional application No. 62/247,303, filed on Oct. 28, 2015.

(51) Int. Cl.
*B25B 33/00* (2006.01)
*A47C 21/02* (2006.01)

(52) U.S. Cl.
CPC ..... *B25B 33/00* (2013.01); *A47C 21/028* (2013.01)

(58) Field of Classification Search
CPC ..... A47C 31/00; A47C 21/028; B25B 27/14; B25B 33/00; A47F 13/08; A01K 23/005
See application file for complete search history.

(56) References Cited

U.S. PATENT DOCUMENTS 310,069 A * 12/1884 Milligan ..... A47F 13/08 294/180
591,953 A * 10/1897 Davenport ..... A47F 13/08 294/180
636,735 A * 11/1899 Davenport ..... A47F 13/08 294/180
1,711,566 A * 5/1929 Jacobs ..... A47F 13/08 294/180
1,728,858 A * 9/1929 Dreher ..... A47F 13/08 294/180
2,563,223 A * 8/1951 Dreher ..... A47F 13/08 294/180
2,774,178 A * 12/1956 Nelson ..... B68G 15/00 81/488
2,871,848 A * 2/1959 Wall ..... A47J 37/10 126/215
D194,596 S * 2/1963 Reid ..... D6/607
3,840,261 A * 10/1974 Fulkerson ..... A47F 13/08 248/224.51
D268,804 S * 5/1983 Bacon ..... D8/14
(Continued)

*Primary Examiner* — Eric J Kurilla

(57) ABSTRACT

The tool for installing fitted bed sheets is an apparatus that facilitates the wrapping of a bed sheet around a corner of a mattress with minimal effort. The apparatus serves as an extension of the user's hand and applies the necessary force onto the elastic band of the bed sheet in the correct direction. The apparatus includes a handle, a sheet-corner brace, a first anchor, a second anchor, a sheet-pressing panel, and a tucking lip. The tucking lip is connected adjacent to the first brace end of the sheet-corner brace and the sheet-pressing panel is connected adjacent to the second brace end of the sheet-corner brace. The handle is connected onto the sheet-pressing panel, opposite to the sheet-corner brace. The first anchor is connected adjacent to the sheet-corner brace. The second anchor is connected adjacent to the sheet-corner brace, opposite to the first anchor.

16 Claims, 10 Drawing Sheets

(56) References Cited

U.S. PATENT DOCUMENTS 4,688,761 A * 8/1987 Wilcox ..... B25B 27/0035 254/104
4,745,650 A * 5/1988 Elliott ..... A47C 21/00 5/669
5,613,660 A * 3/1997 Wyatt ..... A47F 13/08 248/300
6,412,842 B1 * 7/2002 Winston ..... A47F 13/08 294/177
6,612,379 B1 * 9/2003 Timmons ..... A01B 1/02 172/375
7,621,572 B2 * 11/2009 Omdoll ..... A47F 13/08 294/176
D660,115 S * 5/2012 Montross ..... D8/47
8,191,191 B2 * 6/2012 Montross ..... A47C 20/021 254/104
9,155,401 B1 * 10/2015 Wergedal ..... B25B 33/00
2005/0151384 A1 * 7/2005 Omdoll ..... A47F 13/08 294/176
2006/0087136 A1 * 4/2006 Pearl ..... A47F 13/08 294/176
2007/0271706 A1 * 11/2007 Gonser ..... A47C 21/028 5/658
2008/0040859 A1 * 2/2008 Harris-Adamson ..... A47C 21/028 5/658
2009/0140536 A1 * 6/2009 Claypool ..... A47F 13/08 294/176
2009/0167038 A1 * 7/2009 Claypool ..... A47F 13/08 294/178
2011/0099713 A1 * 5/2011 Gonser, Jr. ..... A47C 21/028 5/488
2011/0179578 A1 * 7/2011 Montross ..... A47C 20/021 5/660
2013/0026773 A1 * 1/2013 Rockwell ..... A47F 13/08 294/53.5
2014/0265399 A1 * 9/2014 Young ..... A47F 13/08 294/179
2016/0198863 A1 * 7/2016 Russo ..... A47G 9/0246 5/497

* cited by examiner

TOOL FOR INSTALLING FITTED BED SHEETS

The current application claims a priority to the U.S. Provisional Patent application Ser. No. 62/247,303 filed on Oct. 28, 2015.

FIELD OF THE INVENTION

The present invention relates generally to installation tools. More specifically, the present invention is a tool for installing fitted bed sheets so that a user does not directly push the bed sheets underneath the corners of the mattress.

BACKGROUND OF THE INVENTION

Individuals with conditions such as arthritis have a difficult time performing everyday activities such as making the bed. Bed making can be a taxing task for such individuals as they must bend over to fit the corners of the sheet over the corners of the mattress, causing stress in their back, legs, and hands. There are currently no tools to aid in the physical process of installing bed sheets (i.e. placing the sheet over the corner of the mattress). Existing tools in regard to installing bed sheets simply aid in elevating the mattress to facilitate in tucking the sheets.

Therefore, an objective of the present invention is to assist an individual in the physical process of installing a bed sheet onto a mattress. The present invention is a tool that facilitates in installing fitted bed sheets and that eliminates the need to bend down when installing a bed sheet onto a mattress. Utilizing the present invention, an individual can simply place the tool into the corner of the sheet and push the tool vertically downward along the exterior corner of the mattress. In doing so, the corner of the sheet rides along the tool as the elastic band of the sheet is pushed along the mattress corner and snaps into place once the tool head reaches the base of the mattress. The elongated handle of the tool eliminates the need to bend down to fit the tool over the mattress corner, and the contour of the tool head facilitates in accurately placing the corner of the sheet over the corner of the mattress. Therefore, the present invention provides a unique tool that eliminates the need to bend over when installing fitted sheets onto mattresses.

DETAILED DESCRIPTION OF THE INVENTION

All illustrations of the drawings are for the purpose of describing selected versions of the present invention and are not intended to limit the scope of the present invention.

Figure 1:
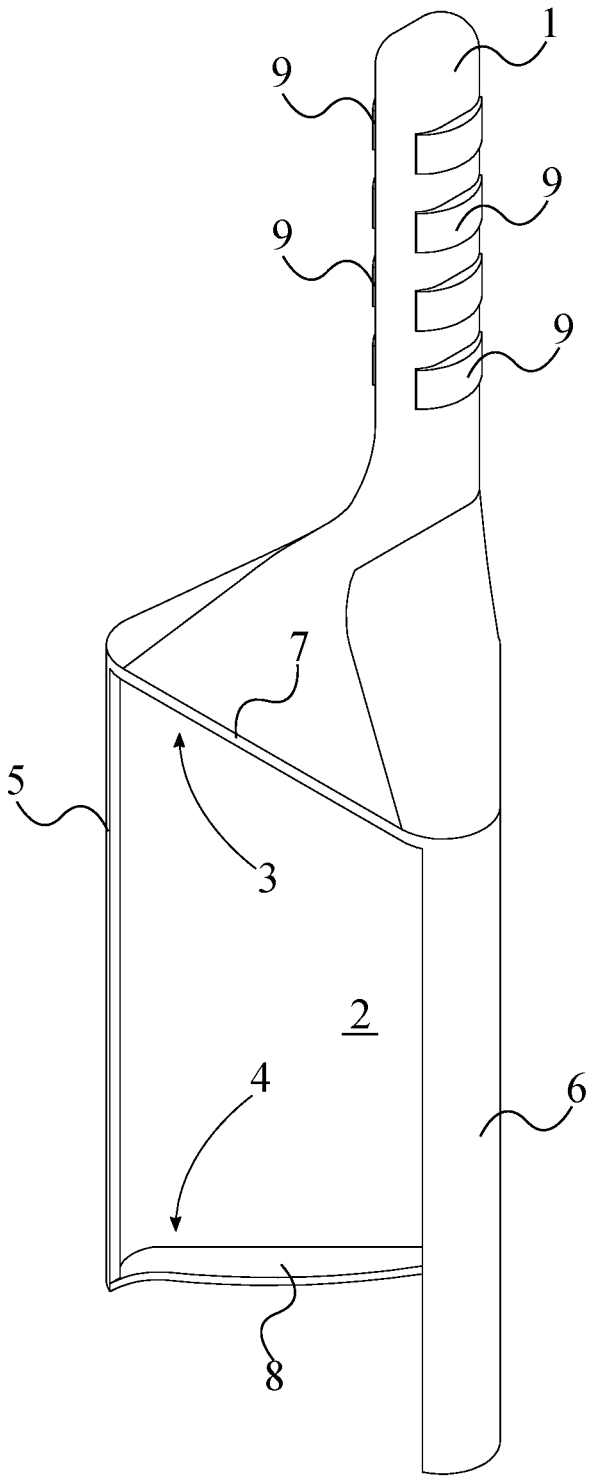
FIG. 1 is a front top perspective view of a preferred embodiment of the present invention, wherein the sheet-corner brace has a right-angle shaped profile in the preferred embodiment.

The present invention is a tool for installing fitted bed sheets that stretches a fitted bed sheet around the corner of a mattress until the elastic band snaps underneath the mattress. The present invention allows a user to properly secure a bed sheet around the corners of a mattress with minimal effort. The present invention comprises a handle 1, a sheet corner brace 2, a first anchor 5, a second anchor 6, a sheet-pressing panel 7, and a tucking lip 8, as illustrated in FIG. 1. The handle 1 allows a user to maneuver the present invention and force a bed sheet around the corner of mattress. The sheet corner brace 2 stretches the corner of a bed sheet and defines the path for which the elastic band slides about the corner of a mattress. The first anchor 5 and the second anchor 6 push the bed sheet away from the sides of a mattress resulting in the elastic band snapping into place underneath the mattress. The first anchor 5 and the second anchor 6 also prevent the elastic band of the bed sheet from popping above the tucking lip 8 as the elastic band traverses along the sides of the mattress corner. The sheet-pressing panel 7 mounts the present invention on the upper surface of the mattress so that the user may pivot the tucking lip 8 underneath the mattress with ease. The tucking lip 8 pushes the elastic band underneath the corner of the mattress as the user pivots the present invention.

Figure 2:
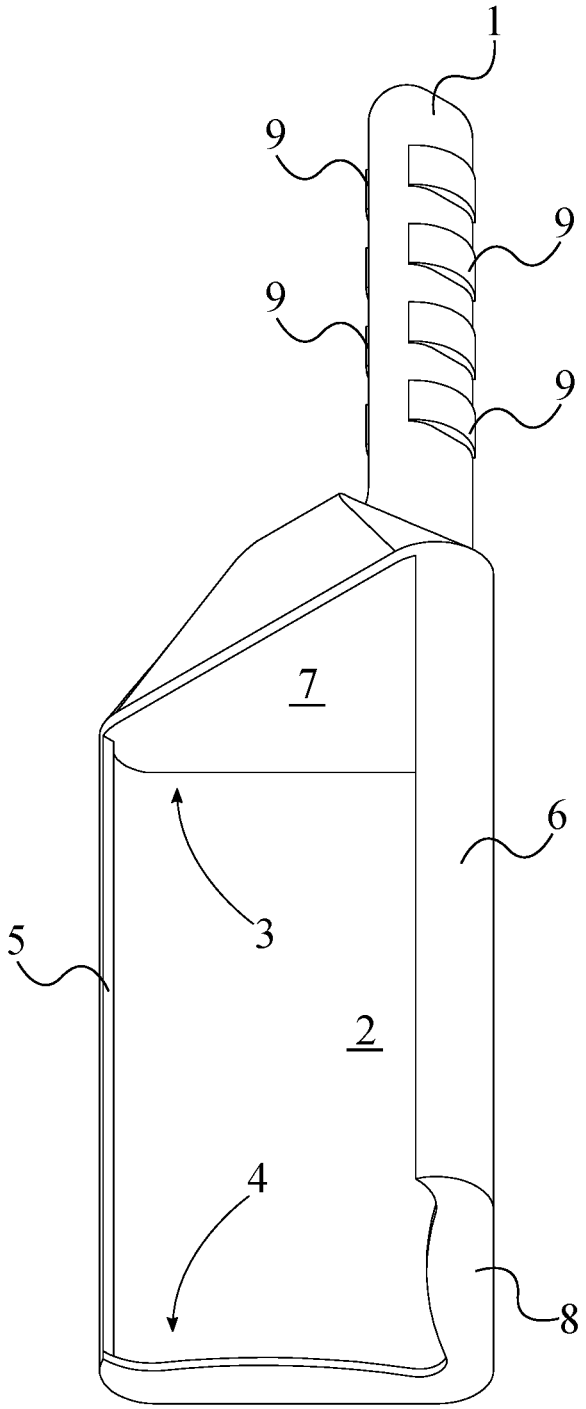
FIG. 2 is a front bottom perspective view of the preferred embodiment of the present invention.
Figure 3:
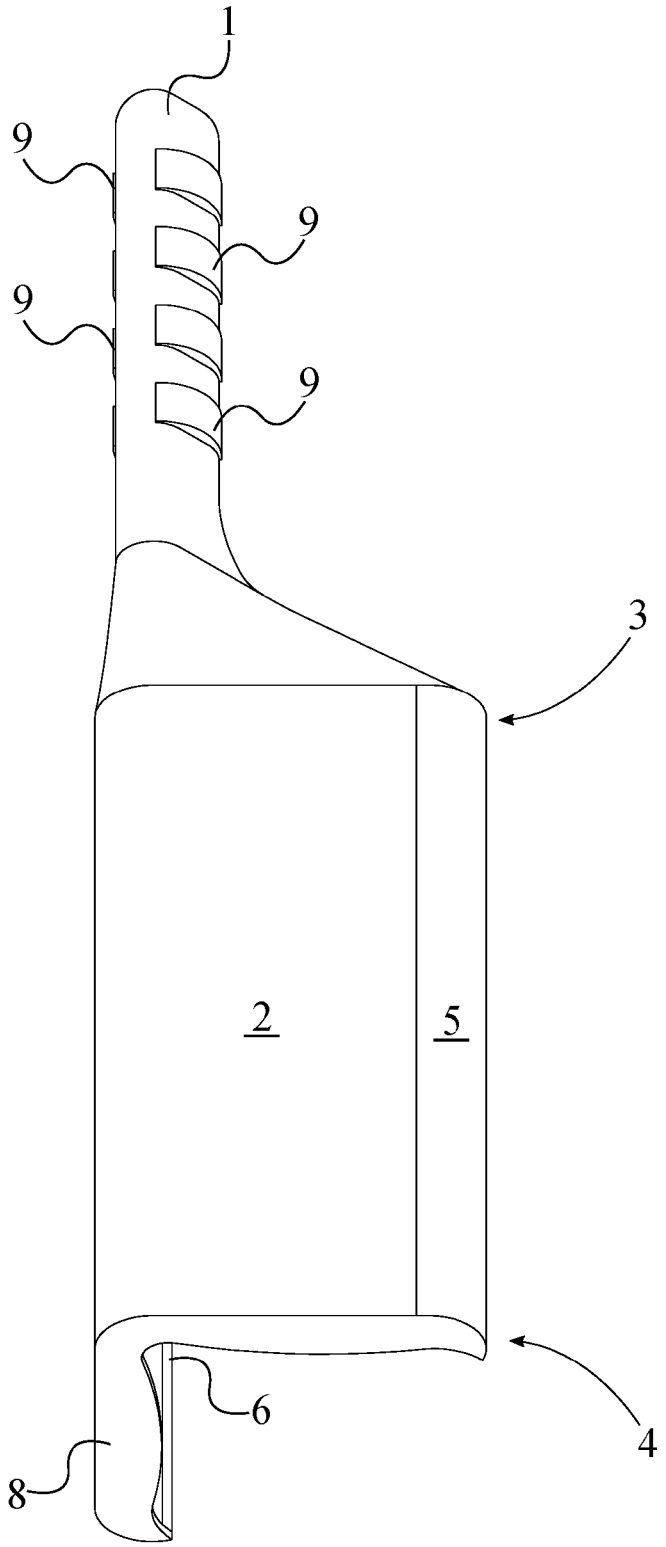
FIG. 3 is a rear bottom perspective view of the preferred embodiment of the present invention.
Figure 4:
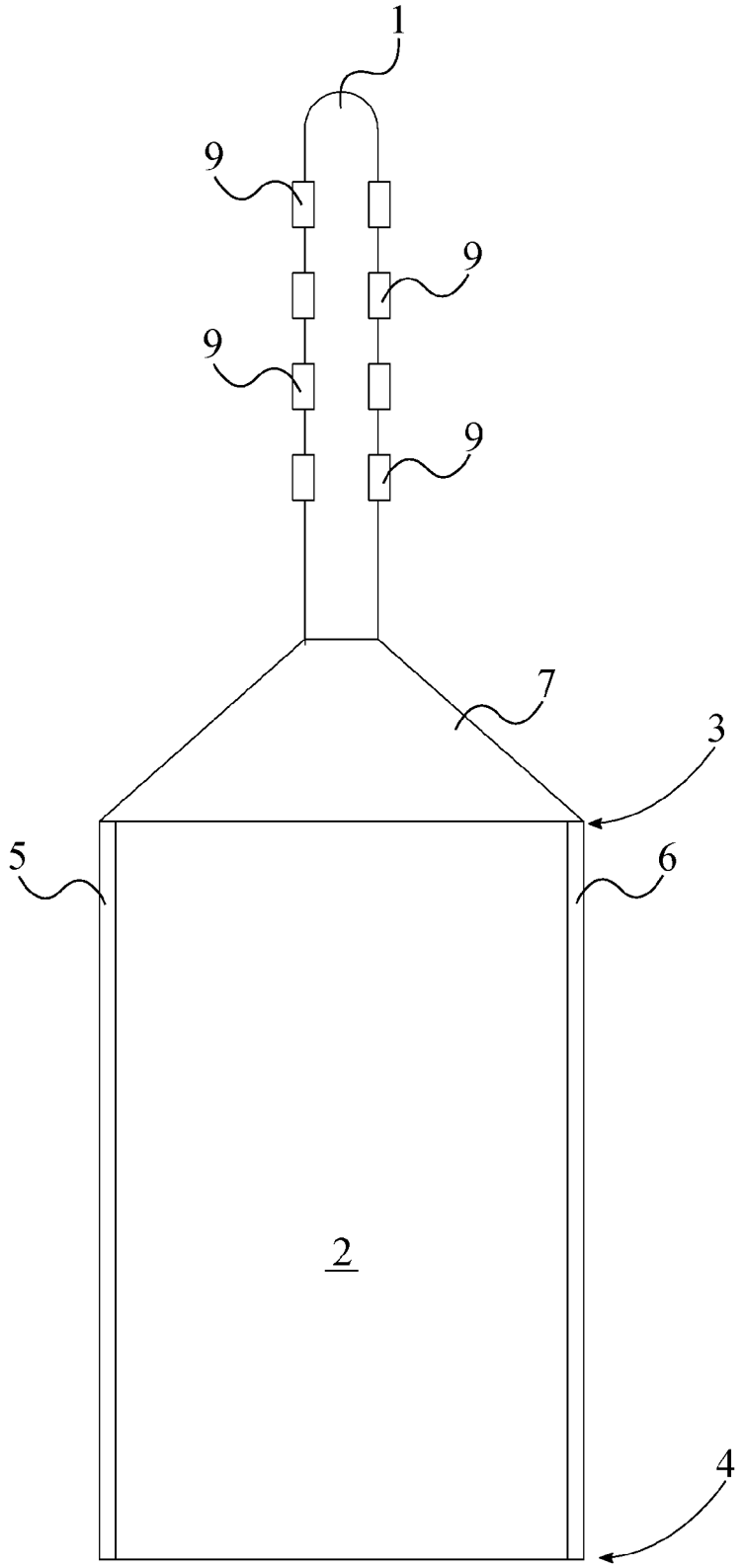
FIG. 4 is a rear side view of the preferred embodiment of the present invention.
Figure 10:
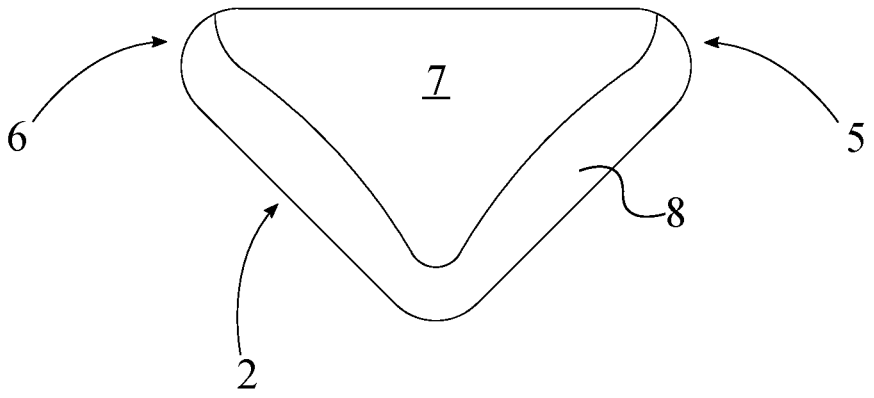
FIG. 10 is a bottom side view of the preferred embodiment of the present invention.

The overall configuration for the aforementioned components allow a user of the present invention to push the corner of the bed sheet without having to slip his or her hand underneath the mattress. The sheet corner brace 2 comprises a first brace end 3 and a second brace end 4. The first brace end 3 and the second brace end 4 are positioned opposite each other across the sheet corner brace 2, as shown in FIG. 2. The tucking lip 8 is connected adjacent to the first brace end 3, and the sheet-pressing panel 7 is connected adjacent to the second brace end 4. The sheet-pressing panel 7 is shown opposite the tucking lip 8 in FIG. 10. This configuration allows tucking lip 8 to slidably engage with the bottom of the mattress while being upheld by the sheet-pressing panel 7. An alternate embodiment of the sheet-pressing panel 7 comprises a friction inducing layer so that present invention does not move as the user pivots the tucking lip 8 underneath the mattress corner. The handle 1 is connected onto the sheet-pressing panel 7, opposite to the sheet corner brace 2, as illustrated in FIG. 3, so that the user may maneuver the bed sheet from a distance. The preferred embodiment of the sheet-pressing panel 7 has a thickness in order to increase the distance between the user and the bottom surface of the mattress. This thickness allows the user to be even further from the bottom of the mattress as the user tucks the bed sheet under the mattress corner. The first anchor 5 is connected adjacent to the sheet corner brace 2. Likewise, the second anchor 6 is connected adjacent to the sheet corner brace 2, opposite to the first anchor 5, as shown in the rear side view of FIG. 4. More specifically, the first anchor 5 and the second anchor 6 are positioned in between the first brace end 3 and the second brace end 4. This configuration allows pushes the elastic band away from the sides of the mattress throughout the length of the sheet corner brace 2 until the elastic band effectively wraps around the corner of the mattress.

Figure 5:
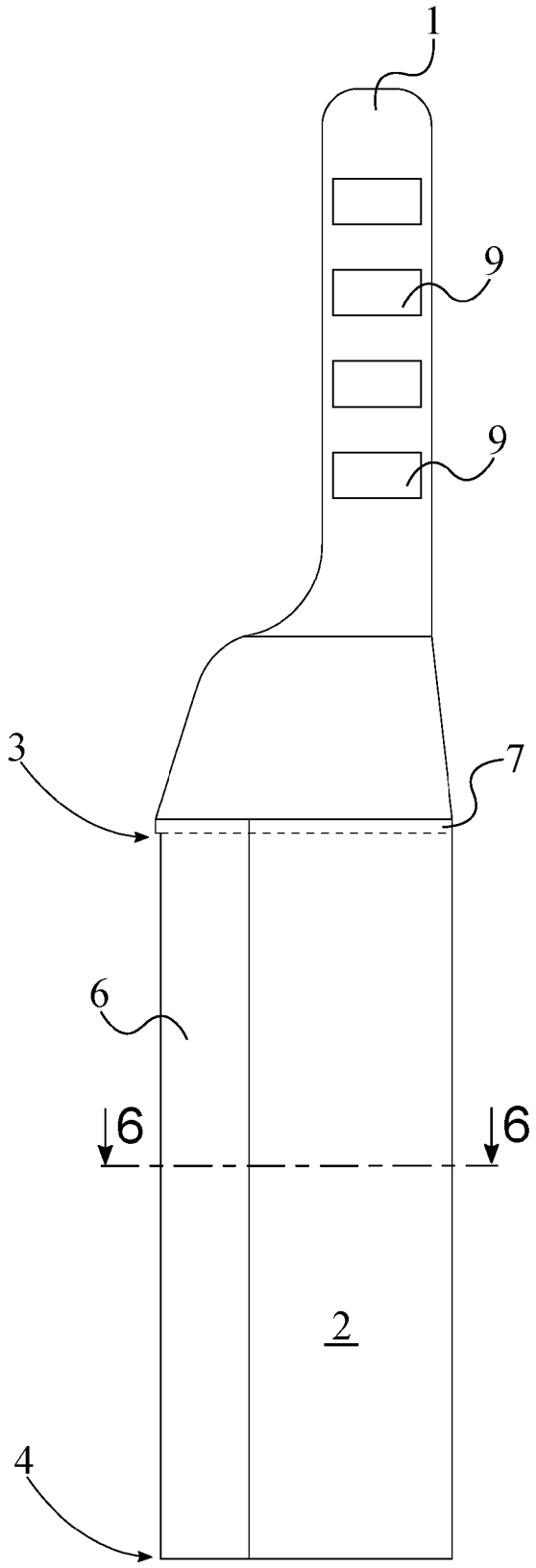
FIG. 5 is a left side view of the preferred embodiment of the present invention.
Figure 6:
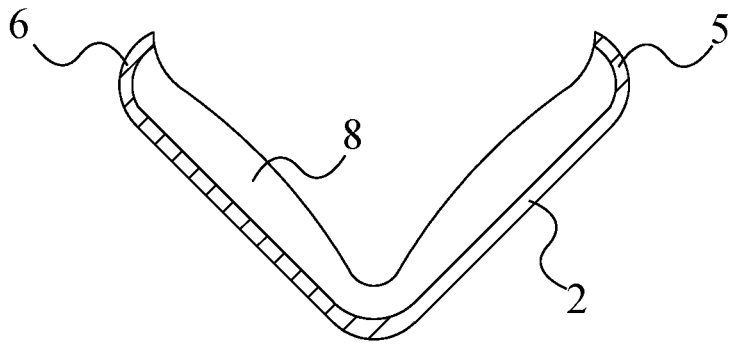
FIG. 6 is a cross-sectional view of the preferred embodiment of the present invention taken along line 6-6 in FIG. 5.
Figure 7:
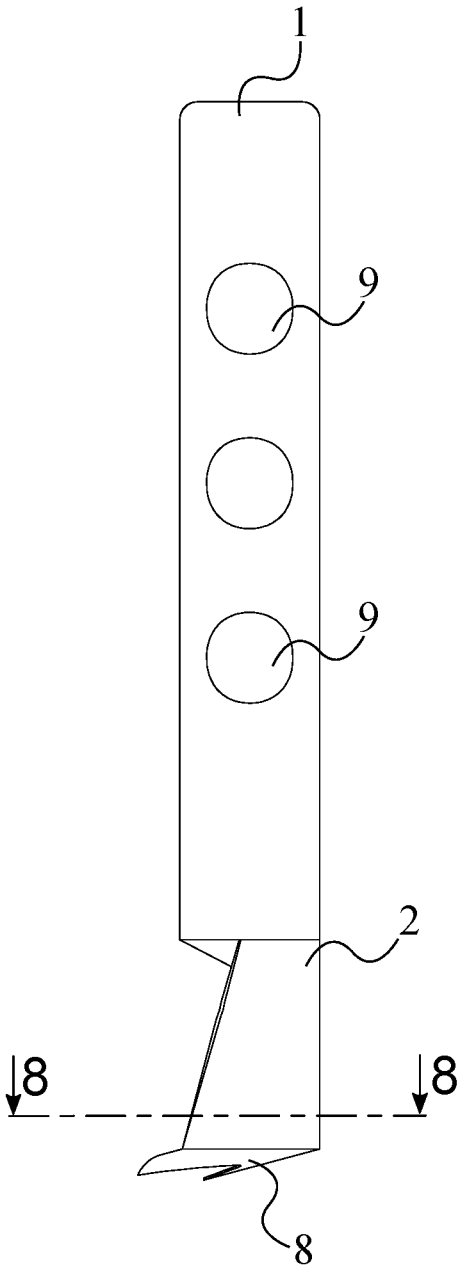
FIG. 7 is a left side view of an alternate embodiment of the present invention, wherein the sheet-corner brace has an arch shaped profile in the preferred embodiment.
Figure 8:
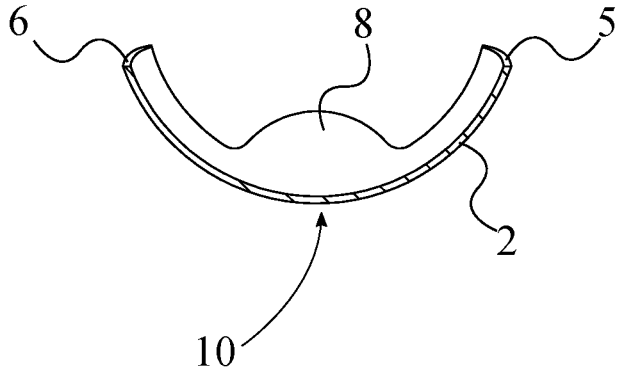
FIG. 8 is a cross-sectional view of an alternate embodiment of the present invention taken along line 8-8 in FIG. 7.

In the preferred embodiment of the present invention, the tucking lip 8 and the sheet-pressing panel 7 are positioned parallel to each other, as shown in FIG. 2. This parallel configuration allows the user to guide the tucking lip 8 underneath the bottom surface of the mattress. Furthermore, in the preferred embodiment of the present invention, the tucking lip 8 is positioned perpendicular to the sheet corner brace 2, and the sheet-pressing panel 7 is also positioned perpendicular to the sheet corner brace 2. This configuration of the preferred embodiment allows the present invention to minimize wasted space in between the sheet-pressing panel 7 and the tucking lip 8 in order to receive the mattress and the bed sheet. In one embodiment of the present invention shown in FIG. 8, a cross-section of the first anchor 5, the sheet-corner brace 2, and the second anchor 6 is an arch shape. This arch shape allows the sheet-corner brace 2 to better fit about an arch shaped mattress corner. More specifically, the handle 1 is positioned adjacent an apex 10 of the arch shape so that the user applies minimal force as the user pivots the tucking lip 8 under the mattress and presses the sheet-corner brace 2 against the sides of the corner of the mattress. This alternate embodiment is illustrated in FIG. 7. In one embodiment of the present invention shown in FIG. 6, a cross-section of the first anchor 5, the sheet-corner brace 2, and the second anchor 6 is a right-angle shape, which is the cross-sectional view of FIG. 5. This right-angle shape allows the sheet-corner brace 2 to better fit about a right-angle shaped mattress corner.

Figure 9:
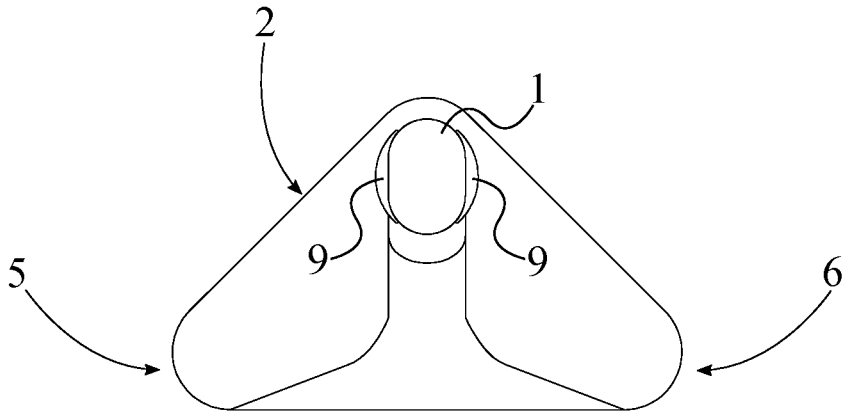
FIG. 9 is a top side view of the preferred embodiment of the present invention.

The present invention further comprises a plurality of grip features 9, as shown in FIG. 1. The plurality of grip features 9 increases the friction between the hand of the user and the handle 1. The plurality of grip features 9 is integrated along the handle 1, as shown in FIG. 9. More specifically, the plurality of grip features 9 is distributed along the handle 1 so that the plurality of grip features 9 corresponds to the placement of the user's fingers on the handle 1. This configuration of the plurality of grips facilitates a proper grip such that the user applies minimal effort as the user pushes the bed sheet under the mattress. The plurality of grips 9 may include, but is not limited to, a plurality of rubber pads, a plurality of indentations, and a plurality of gel pads.

Although the invention has been explained in relation to its preferred embodiment, it is to be understood that many other possible modifications and variations can be made without departing from the spirit and scope of the invention as hereinafter claimed.

What is claimed is:

1. A tool for installing fitted bed sheets comprises:
a handle;
a sheet-corner brace;
a first anchor;
a second anchor;
a sheet-pressing panel;
a tucking lip;
the sheet-corner brace comprises a first brace end and a second brace end;
the first brace end and the second brace end being positioned opposite to each other across the sheet-corner brace;
the tucking lip being connected adjacent to the first brace end; the tucking lip and the sheet-pressing panel being positioned parallel to each other; the tucking lip being positioned perpendicular to the sheet-corner brace;
the sheet-pressing panel being connected adjacent to the second brace end;
the handle being connected onto the sheet-pressing panel, opposite to the sheet-corner brace;
the first anchor being connected adjacent to the sheet-corner brace;
the second anchor being connected adjacent to the sheet-corner brace, opposite to the first anchor; and,
the first anchor and the second anchor being positioned in between the first brace end and the second brace end.

2. The tool for installing fitted bed sheets as claimed in claim 1 comprises:
the sheet-pressing panel being positioned perpendicular to the sheet-corner brace.

3. The tool for installing fitted bed sheets as claimed in claim 1 comprises:
a transversal cross-section of the first anchor, the sheet-corner brace, and the second anchor being an arch shape.

4. The tool for installing fitted bed sheets as claimed in claim 3 comprises:
the handle being positioned adjacent an apex of the arch shape.

5. The tool for installing fitted bed sheets as claimed in claim 1 comprises:
a transversal cross-section of the first anchor, the sheet-corner brace, and the second anchor being a right-angle shape.

6. The tool for installing fitted bed sheets as claimed in claim 1 comprises:
a plurality of grip features; and,
the plurality of grip features being integrated along the handle.

7. The tool for installing fitted bed sheets as claimed in claim 6 comprises:
the plurality of grip features being distributed along the handle.

8. A tool for installing fitted bed sheets comprises:
a handle;
a sheet-corner brace;
a first anchor;
a second anchor;
a sheet-pressing panel;
a tucking lip;
a plurality of grip features;
the sheet-corner brace comprises a first brace end and a second brace end;
the first brace end and the second brace end being positioned opposite to each other across the sheet-corner brace;
the tucking lip being connected adjacent to the first brace end; the tucking lip and the sheet-pressing panel being positioned parallel to each other; the tucking lip being positioned perpendicular to the sheet-corner brace;
the sheet-pressing panel being connected adjacent to the second brace end;
the handle being connected onto the sheet-pressing panel, opposite to the sheet-corner brace;
the first anchor being connected adjacent to the sheet-corner brace;
the second anchor being connected adjacent to the sheet-corner brace, opposite to the first anchor;
the first anchor and the second anchor being positioned in between the first brace end and the second brace end;
the plurality of grip features being integrated along the handle; and, the plurality of grip features being distributed along the handle.

9. The tool for installing fitted bed sheets as claimed in claim 8 comprises:

the sheet-pressing panel being positioned perpendicular to the sheet-corner brace.

10. The tool for installing fitted bed sheets as claimed in claim 8 comprises:

a transversal cross-section of the first anchor, the sheet-corner brace, and the second anchor being an arch shape.

11. The tool for installing fitted bed sheets as claimed in claim 10 comprises:

the handle being positioned adjacent an apex of the arch shape.

12. The tool for installing fitted bed sheets as claimed in claim 8 comprises:

a transversal cross-section of the first anchor, the sheet-corner brace, and the second anchor being a right-angle shape.

13. A tool for installing fitted bed sheets comprises:

a handle;

a sheet-corner brace;

a first anchor;

a second anchor;

a sheet-pressing panel;

a tucking lip;

the sheet-corner brace comprises a first brace end and a second brace end;

the first brace end and the second brace end being positioned opposite to each other across the sheet-corner brace;

the tucking lip being connected adjacent to the first brace end;

the sheet-pressing panel being connected adjacent to the second brace end;

the handle being connected onto the sheet-pressing panel, opposite to the sheet-corner brace;

the first anchor being connected adjacent to the sheet-corner brace;

the second anchor being connected adjacent to the sheet-corner brace, opposite to the first anchor;

the first anchor and the second anchor being positioned in between the first brace end and the second brace end;

the tucking lip and the sheet-pressing panel being positioned parallel to each other;

the tucking lip being positioned perpendicular to the sheet-corner brace; and, the sheet-pressing panel being positioned perpendicular to the sheet-corner brace.

14. The tool for installing fitted bed sheets as claimed in claim 13 comprises:

a transversal cross-section of the first anchor, the sheet-corner brace, and the second anchor being an arch shape; and, the handle being positioned adjacent an apex of the arch shape.

15. The tool for installing fitted bed sheets as claimed in claim 13 comprises:

a transversal cross-section of the first anchor, the sheet-corner brace, and the second anchor being a right-angle shape.

16. The tool for installing fitted bed sheets as claimed in claim 13 comprises:

a plurality of grip features;

the plurality of grip features being integrated along the handle; and, the plurality of grip features being distributed along the handle.

* * * * *